US005772362A

United States Patent [19]

Sims

[11] Patent Number: 5,772,362

[45] Date of Patent: Jun. 30, 1998

[54] RACING RAIL POLE DRIVER APPARATUS AND THE METHOD OF USE THEREOF

[75] Inventor: Anthony McGregor Sims, Mt. Barker, Australia

[73] Assignee: Aclis Pty Ltd, Australia

[21] Appl. No.: 613,961

[22] Filed: Mar. 8, 1996

[30] Foreign Application Priority Data

Mar. 10, 1995 [AU] Australia ..... PN 1611
Jan. 25, 1996 [AU] Australia ..... PN 7760

[51] Int. Cl.[6] ..... E02D 11/00; E21B 7/02; E21B 11/02; E21C 11/00

[52] U.S. Cl. ..... 405/232; 175/19; 173/184; 405/231; 405/303

[58] Field of Search ..... 405/232, 231, 405/303; 111/109; 172/5; 173/42, 28, 193, 194, 184; 175/19, 20

[56] References Cited

U.S. PATENT DOCUMENTS

| | | | |
|---|---|---|---|
| 3,507,338 | 4/1970 | McWaters et al. | 173/28 |
| 3,583,514 | 6/1971 | Tyalor | 172/5 X |
| 3,860,906 | 1/1975 | Browing | 172/5 X |
| 4,193,459 | 3/1980 | Engstrom | 173/43 |
| 4,765,596 | 8/1988 | Fontana . | |
| 4,915,180 | 4/1990 | Schisler | 173/22 |
| 5,040,772 | 8/1991 | Greens . | |
| 5,315,074 | 5/1994 | Berquist | 175/19 X |
| 5,490,568 | 2/1996 | Rios et al. | 405/232 X |

*Primary Examiner*—Dennis L. Taylor
*Attorney, Agent, or Firm*—Klauber & Jackson

[57] ABSTRACT

The movement of relocatable racing rails (10) by manual labor involves the extraction of poles (16) from the ground and re-insertion of each pole a fixed distance from its adjacent pole along the path of the new location of the racing rail, thereby resulting in a time consuming and very labor intensive operation wherein inaccuracies in placement of the poles can result in misfits of the relocatable rails over the poles, whereby readjustment is often required. A transportation apparatus (28) is provided for carrying poles (16) and measuring a fixed distance between the last pole and a pole driver mechanism (32) for driving the next pole (66) into the ground. The pole driver is allowed to move relative to the transportation apparatus as the apparatus moves along the ground, but the relative movement is arranged so as to maintain a fixed distance to the last pole for a time shortly before, during and after the pole driver mechanism is actuated to drive a pole into the ground. The pole driver mechanism is attached to the transportation apparatus by a parallelogram arrangement (42, 56, 58) which allows the required relative movement. Sensor (72) mounted between the transportation apparatus and the pole drive mechanism detects the relative movement and a rate of travel of the transportation apparatus is provided so that as the pole driver mechanism becomes more vertical with respect to the transportation apparatus, the speed across the ground is reduced and, if necessary, the transportation apparatus is stopped.

10 Claims, 5 Drawing Sheets

RACING RAIL POLE DRIVER APPARATUS AND THE METHOD OF USE THEREOF

This invention relates to relocatable rails used to form a boundary for racing an in particular to a method and means for locating and extracting poles upon which relocatable rails are placed.

BACKGROUND

Relocatable racing rails in the horse racing industry are known.

One example of such a coil system is described in U.S. Pat. No. 4,765,596 dated 23rd August 1988 for "RACE TRACK CONVERTIBLE GUARD RAIL", which relates in particular to a pole fixture and other components which are located in the ground. An inground pole fixture is formed from a first flexible outer tube portion which extends at least to the surface of the ground and a second inner tube portion which is retained in the outer tube portion and located below the surface of the ground and is typically made of hard plastic or steel. The inner lower tube portion is used to support a resilient upright pole upon which is placed a hollow post which, supports the racing rail.

In this specification poles (sometimes also referred to a pins or stakes) are located at predetermined positions in the ground and posts which support the rail slide over the poles.

Approximately 6 meter lengths of rail and integral posts are positioned onto three poles spaced three (3) meters apart. Rails are joined at their free ends to make the rail structure continuous about the race course.

When in place the rail and posts must be sturdy enough to withstand the direct, but mainly glancing, blow of a horse and its mounted jockey.

The upright in-ground poles are generally made of a resilient material having the strength to support both the post and rail sections as well as absorbing one or more blows of the type described above, These upright in-ground poles preferably withstand these forces without breaking or splintering and in most cases return the horse and its jockey towards the race course.

The safety of jockey and horse is an important consideration in the design of a suitable racing rail system.

The posts and rail sections are relocatable so that racing track wear can be distributed evenly over the available track surface.

However, a large manual labour effort is required to relocate 1 to 2 kilometers of post and rail assemblies. Typically, 30 to 40 labourers can take 4 to 5 hours to reposition a 2 kilometer post and rail assembly.

Each 6 meter length of post and rail is lifted off the upright in-ground poles and each upright in-ground pole is extracted and hammered into its new position after which the post and rail section is lowered into its new location.

Typically a 21 meter chain with marks at 3 meters spacing is temporarily attached to a first pole and each pole along the length of the chain is hammered into the ground adjacent each successive 3 meter mark. After each upright pole along a 6 meter length is positioned in the ground, a post and rail section is located over them and adjacent rail sections similarly located and then connected together with joiners.

It is not unusual for the manual operation to space the inground poles too close or too far apart so that the posts and rail sections can not be properly fitted and repeated extraction and relocation of one or more in-ground poles is sometimes necessary.

This invention provides an apparatus and method for accurately relocating a racing rail which overcomes the abovementioned problems while using less labour content than previous methods.

BRIEF DESCRIPTION OF THE INVENTION

In a broad aspect of the invention an apparatus for locating in the ground two or more poles for supporting a racing rail assembly comprising, a transportation means for carrying a plurality of poles, a pole driver means pivotally fixed to said transportation means and operable to drive a pole into the ground, and a first measurement means located on said transportation means operable for measuring a predetermined distance between a previously driven pole and said pole driver means, wherein as said transportation means moves along the intended path of said racing rail assembly said first measurement means measures a predetermined distance between previously driven pole and said pole driver means, and said pole driver means is actuated so as to drive a pole into the ground which is a predetermined distance from said previously driven pole.

In a further aspect of the invention a second measurement located on said transportation means means operable for measuring a predetermined distance between an existing rail assembly and said apparatus for maintaining a constant distance at which said poles are driven into the ground from said existing rail assembly.

In yet a further aspect of the invention said pole driver pivotal fixing comprises a pole locating apparatus according to claim 1 wherein said pole driver pivotal fixing comprises a parallelogram arrangement having an upper and lower ends which are arranged to allow said pole driver means to move longtitudinally of said transportation means while remaining substantially vertical with respect to said transportation means.

DETAILED DESCRIPTION OF THE INVENTION

Figure 1:
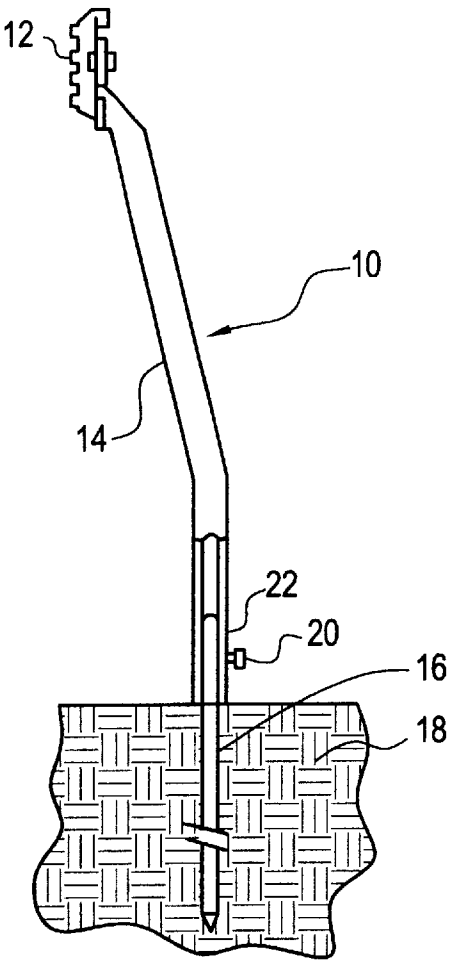
FIG. 1 depicts a partial cross-section of a post and rail section attached to an upright in-ground pole.

FIG. 1 depicts a side view of a post and rail assembly 10 comprising a substantially horizontal rail member 12 which is attached to a flattened portion of a post 14. The post is typically of hollow construction.

An upright in-ground pole 16 has been located in the ground 18 such that at least 150 mm of the pole is located above the ground level. Various lengths of poles are suitable for the various conditions of the soil and poles of 655 mm and 855 mms are typically used.

At the base of the post 14 a threaded bolt 20 in located external of the post which is threadably engaged with a fixed nut 22 on the internal surface of the post 14. When the threaded bolt 20 is screwed inwards the post 14 located over the in-ground pole 16 is forced against the in-ground pole and fixes it thereto.

Figure 2:
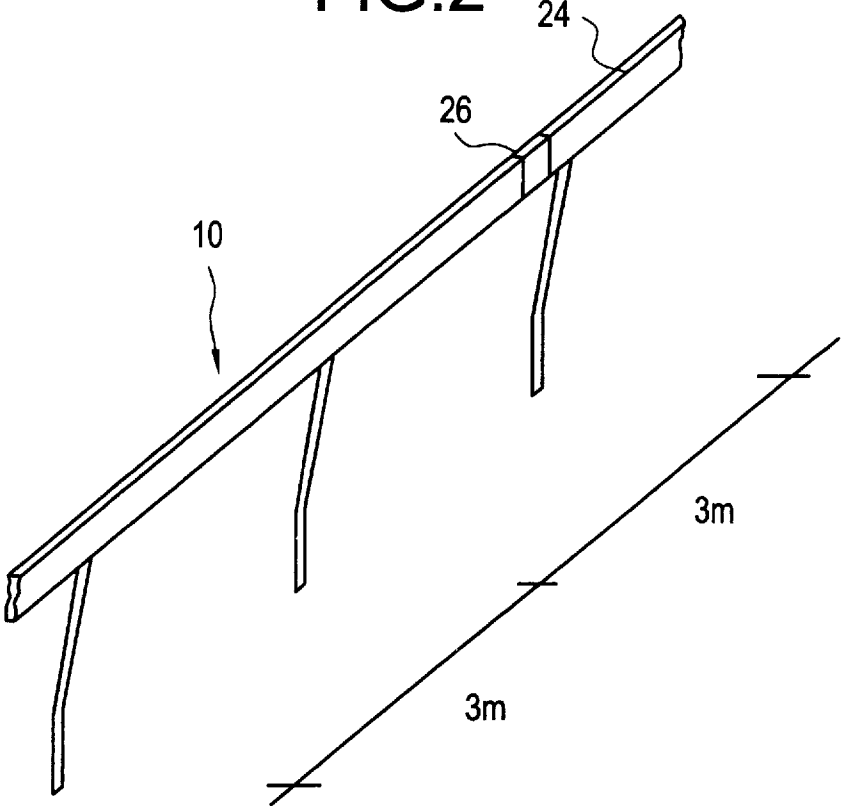
FIG. 2 depicts a side perspective view of a post and rail section adjacent another post and rail section.

FIG. 2 depicts a post and rail assembly 10 having at least 2 posts supporting a rail and a further post and rail assembly 24 adjacent thereto. A joining member 26 joins the rails to provide a continuous rail along the length of the racing rail assembly. In this embodiment the spacing between adjacent poles is 3 meters.

Figure 3:
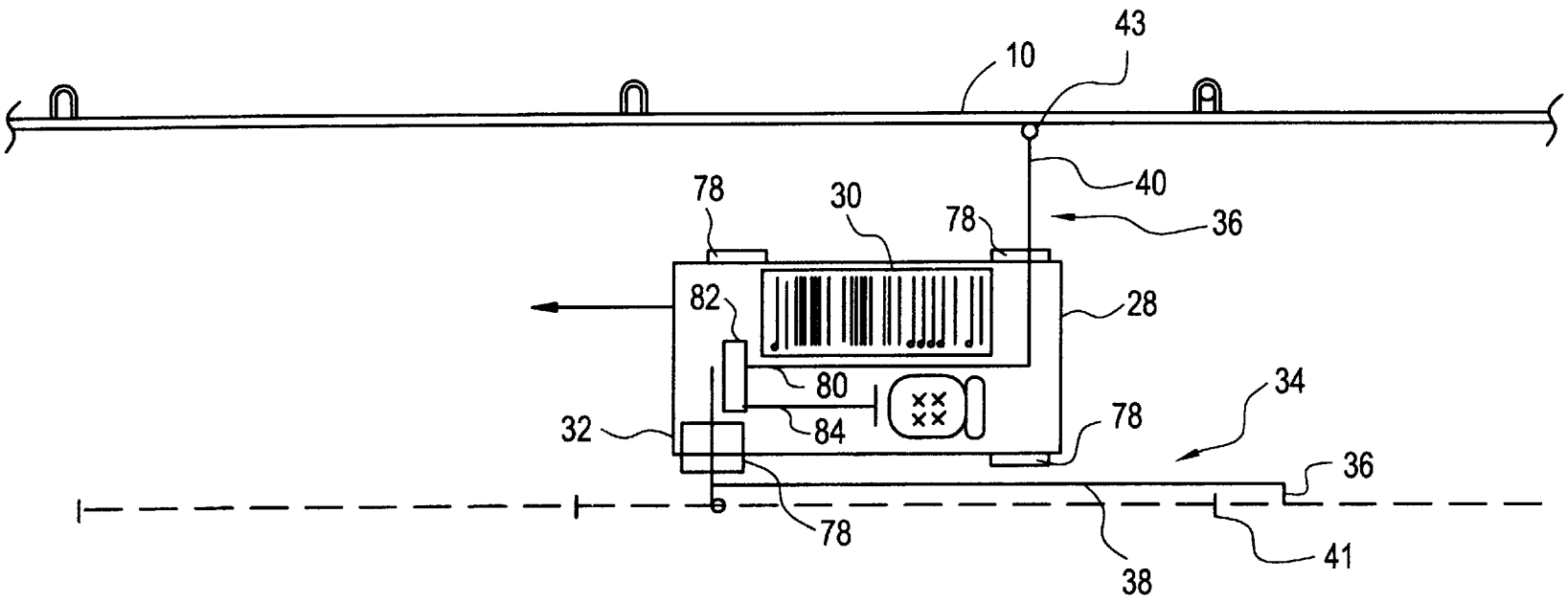
FIG. 3 depicts an apparatus for locating upright in-ground poles spaced a constant distance from an existing post and rail assembly.
Figure 4:
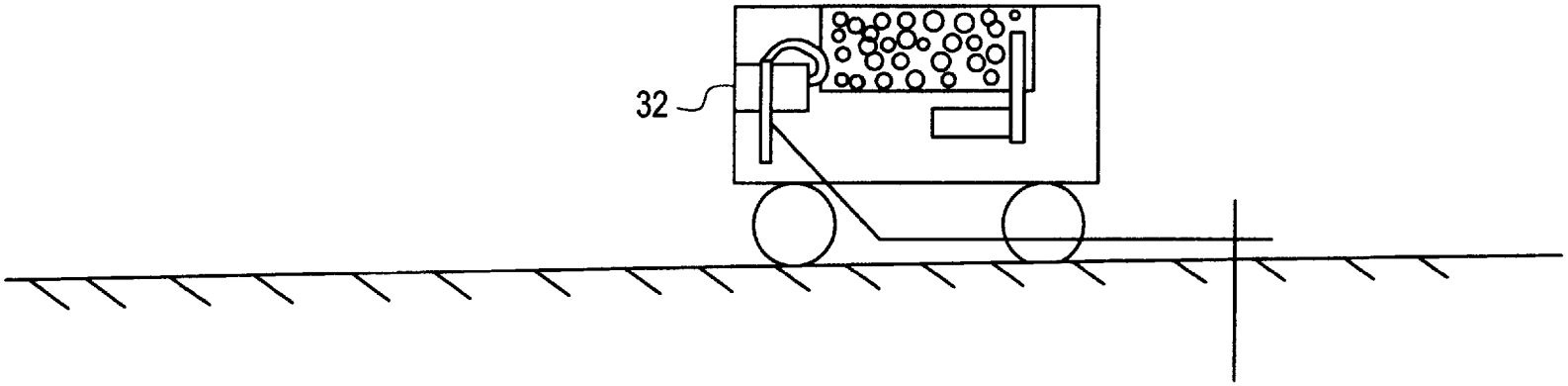
FIG. 4 depicts a side perspective of an apparatus for locating an upright in-ground pole.

FIG. 3 depicts a top view of an existing post and rail assembly 10 and a transportation means 28 which travels parallel to the existing post and rail assembly. The transportations means 28 carries a plurality of poles 30, as well as a pole delivery means for delivering poles to a pole driver means 32 which drives poles one at a time into the ground preferably during the movement of the transportation means and along the path of the new post and rail assembly location at equal distances apart.

The pole delivery means may comprise a person (the transportation means operator) or may comprise a machine.

A first measurement means 34 is used to determine when and where the pole driver means 32 is to be actuated to drive poles into the ground at the appropriate location.

Having described in broad detail the elements of the invention a more detailed description of at least one embodiment of the invention will now be provided. It would be understood by those skilled in the art that there are many variations in the way in which each of the elements described can be implemented and that no one way or combination of ways is necessarily better than the other as long as the broad functional requirements described are met.

In a preferred embodiment the transportation means is a four wheeled vehicle having four wheels 78 sufficient strength and carry rapacity to accommodate at least an operator (pole delivery means), a storage space for carrying a plurality of poles, 30, and the pole driver means 32.

In one embodiment the pole driver means 32 may comprise a hydraulically driven ram located so as to thrust a pole vertically and downwardly into the ground upon actuation. Each pole when taken from the pole storage area may be mechanically or manually inserted into the pole driver means in anticipation of actuation at an appropriate time and location.

The transportation means may be operated by any convenient power source. However, since it is likely that the pole driver means will be hydraulically operated it may be advantageous to power the transportation means with hydraulic means as well.

The typical means for providing hydraulic operation includes a petrol or natural gas driven pump set and various control levers and hydraulic lines to the hydraulically driven elements. All the various control levers may be located adjacent the operator of the transportation means.

Further the transportation means may be steered from the drivers location, the steering being performed by hydraulic rams which orientate either front and/or rear wheels. The pole driver means and transportation means operator could be alternatively off centre located so as to provide the counter balancing required while the pole driver means is actuated.

Referring to FIG. 3 a second distance measuring means 36 may be located on the transportation means to determine a predetermined fixed distance from an existing post and rail assembly and this second measurement means may be linked by connection 80 electronically/hydraulically or mechanically to the steering mechanism 82 which includes steering wheel 84 of the transportation means 28 so as to allow the transportation means to automatically move along a path a constant distance from an existing post and rail assembly without intervention or control by the transportation means operator.

The second measurement means may also be linked to the steering mechanism 82 however for safety reasons it may be possible for the driver to over-ride the automatic control with an over-ride means 86.

Whether the means to locate poles in the pole driver means 32 is manual or automatic, it is preferable to shape the upper portion of the pole to allow each of them to be temporarily secured one at a time within the pole driver means until the driving mechanism has been actuated. This may be in the form of an expanded portion along the upper part of the pole which engages with a complementary gripping shape or mandrel located internal of the pole driver means the grip required only being necessary to stop the pole dropping out.

As previously described the poles are preferably made of a resilient material and will possibly have various lengths dependent on ground conditions. The pole driver means is set above the ground at a predetermined height to ensure that the exposed portion of the in-ground pole when driven is: substantially the same distance after each operation Preferably the height of the pole exposed above ground level is 150 mm.

One embodiment of the first measurement means may comprise a shaft 38 which projects rearwardly of the transportation means 28 from the vicinity of the pole driver means 32 and which is linked to the actuation mechanism of the pole driver means as well as the speed control means of the vehicle.

A hook, roller or other form of engagement means 39 projects from the shaft 38 and when it engages with a previously set in-ground pole 41 the shaft which is linked to the pole driver means actuates the driver means. The next pole is thus located a predetermined distance from the previously located pole. There is also a linkage from the rod to a potentiometer which according to its valve, controls the speed of the transportation means thus slowing or nearly halting during actuation of the pole driving means.

This particular embodiment uses a mechanical measurement gauging approach. However, this is but one example of a measurement means capable of performing this function. It may also be possible to determine a predetermined distance from an existing in-ground pole by way of non-contact means e.g. opto-electronic, ultra-sonic, radar etc. However, it is preferable that the first measurement means accurately locate each successive in-ground pole position to an accuracy acceptable for the placement of post and rail assemblies thereon which is between 1 and 3 mm.

It is also preferable that the first measurement means is useable while the transport means is moving or at least being slowed down in a controlled manner. This ensures that the speed with which the in-ground poles are located is as quick as possible.

Figure 5:
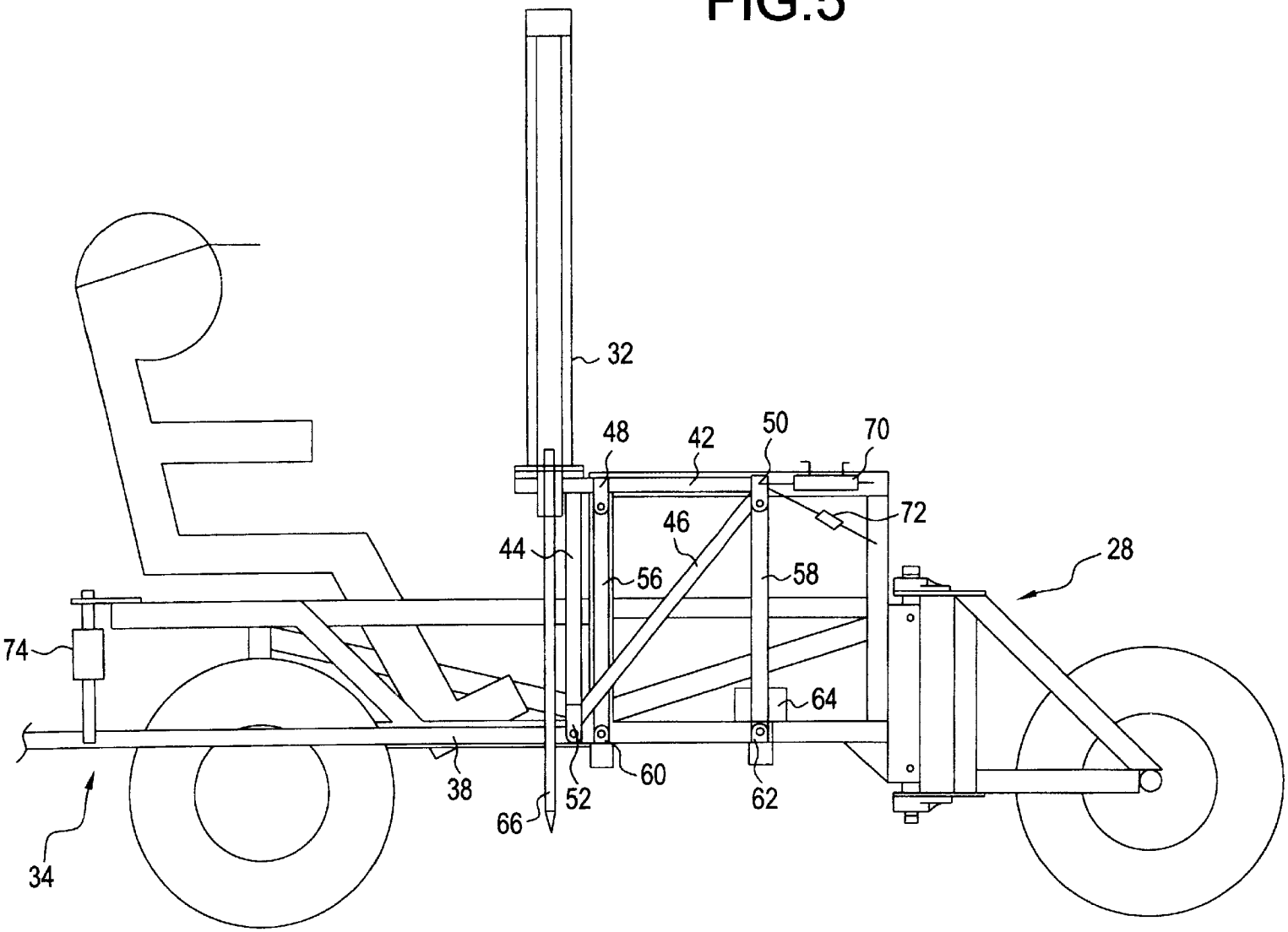
FIG. 5 depicts a side perspective of an apparatus for locating an in-ground pole.

The transportation means may preferably be found more easily controllable with a constant forward velocity rather than requiring the transport means to continually stop and start. This however may require the pole driving means to be moveable with respect to the transportation means. An embodiment of this type is shown in FIG. 5.

The second measurement means 36 as depicted pictorially in FIG. 3 provides for measurement of a predetermined distance of the new location of the in-ground poles from an existing post and rail assembly. The second measurement means may comprise a mechanical linkage (hydraulic control lever arm) 80 between the steering mechanism 82 of the transportation means 28 and rod 40 which has a predetermined length such that the pole driver means will insert poles in the ground a predetermined constant distance from an existing post and rail assembly.

In one example the rod 40 may support a roller 43 which rolls along the outer surface of the rail member 12 located on the post and rail assembly 10 and which also is sensitive to the roller not contacting the rail assembly such that the transportation means is controlled to maintain a path which is parallel to the existing post and rail assembly.

The second measurement means is shown and described in the preferred embodiment is mechanical in nature. However, it is possible to use contactless means to determine a path parallel to the existing post and rail assembly, In a further embodiment of the invention, an apparatus for locating and extracting an in-ground pole, is depicted in FIG. 5, In this embodiment the pole driver means 32 floats with respect to the frame of the transportation means 28 so that the transportation means need not completely stop or slow down as much while a pole is being driven into the ground.

The pole driver means 32 (typically an hydraulically driven ram) is fixed to a frame comprising a top element 42 a vertical element 44 and a bracing element 46 having pivot members 48 and 50 attached to the top element and a further pivot member 52 attached to the join of the vertical element and the shaft 38. The shaft 38 extends rearwardly and beside the transportation means which is the fixed length measurement portion of the first measurement means 34.

The pivot members 48 and 50 are arranged to pivot on the upper ends of upright members 56 and 58 which themselves are arranged to pivot at their lower ends at pivot members 60 and 62 which are fixed to the frame 28 of the transportation means.

Figure 7:
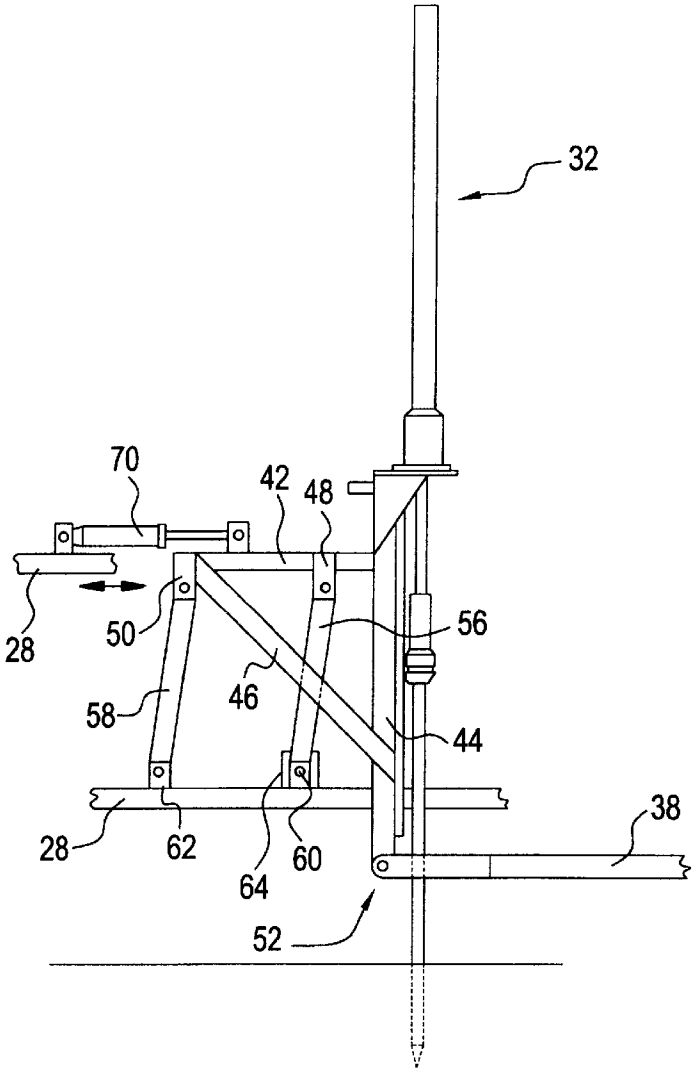
FIG. 7 depicts a side view of the pole location and extraction means at the moment of insertion.
Figure 6:
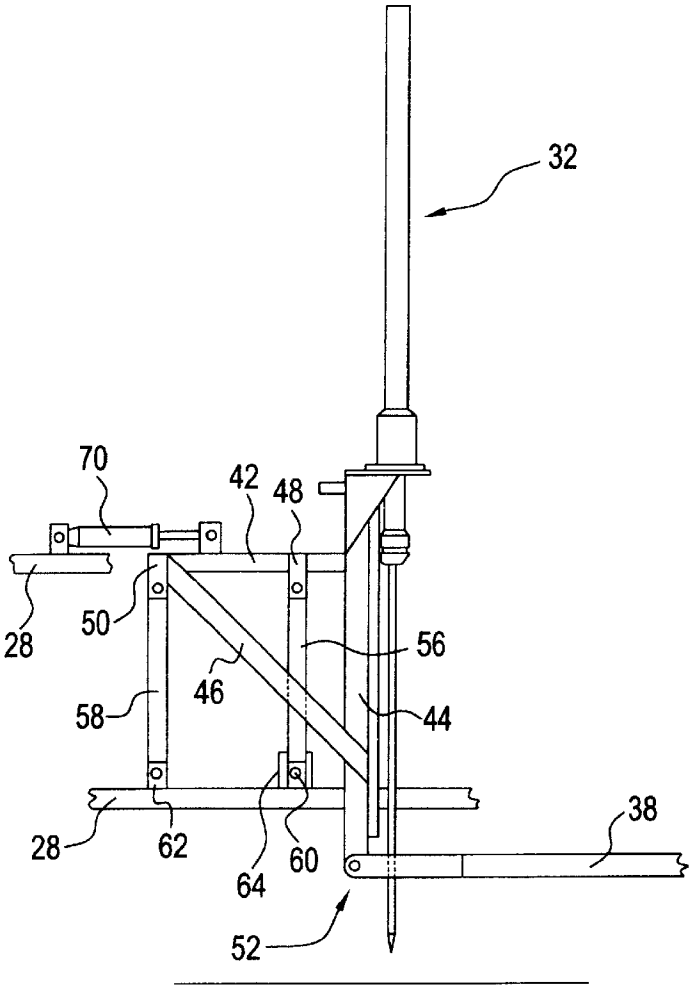
FIG. 6 depicts a side view of the pole location and extraction means ready for insertion.

From FIGS. 6 and 7 it can be seen that the pole driver means 32 can move forward and backward (as indicated by the directional arrow) with respect to the longitudinal axis of transportation means with the aid of the parallelogram mechanism described above while keeping the pole driver ram vertical.

In use the pole driver means 32 is biased slightly forward of the position shown in FIG. 5 by a two-way hydraulic ram 70 which is filled with hydraulic oil so as to draw the frame toward the front of the transportation means. Once the first measurement means 34 is mechanically drawn rearward by the shaft 38 and along with it the pole driver means supported as it is by the parallelogram mechanism, an actutation of the pole driver is initiated when the pole driver ram is located a fixed predetermined distance from the last driven pole (as shown in FIG. 5). Thus a small minimal forward motion of the transportation means can be accommodated while the pole is being driven vertically into the ground while the distance between the last pole and the newly driven pole remains constant. The ability to provide a constant distance between successive poles can be very useful since any inconsistency will readily show up over the long distances (100's of meters of race track) of the racing rail being installed, Furthermore, control box 64, is used to detect movement of the pole driving framework by way of movement of a sensor 72 which preferably is a potentiometer. As the value of the signal received from the sensor indicates the pole driving framework is nearing a right angle with respect to the frame 28 the speed of the transportation means is reduced almost to a standstill. A graduated or infinitely variable position detection device such as a potentiometer is most suitable for providing a position detection sensor and as the framework moves to provide a right angle position the transportation means can be made to proportionately slow down. Thus the floating pole driving means can be actuated and during its operation to locate the pole 66 in the ground with a vertical orientation and without any or little forward tilt caused by movement of the transportation means during the insertion process. Normal speed will resume after insertion of the pole. The control box can automatically operate the forward speed of the hydraulically driven transportation means without operator intervention.

Once the pole has been driven into the ground the hook, roller or other form of engagement means 39 at the free end of the shaft 38 which in this embodiment is a roller, must be cleared of the prior pole thus freeing it to roll to the pole just driven into the ground.

Actuation of the ram 32 which operates very quickly could be one trigger for the actuation of ram 74 which is connected at one end, to the frame of the transportation means and at the free end of the ram rode to a point intermediate the framework and the roller along the shaft 38. The ram 74 retracts its arm and raises the shaft 38 and the roller 39 over the pole and then lowers it after a predetermined period of time if the transportation means is detected as moving forward during that period of time.

The apparatus disclosed in each of the embodiments described above are also capable of extracting poles from the ground. The pole driver means 32 is preferably a double action ram being operable under load to thrust downward and lift upwardly so that if located over the free end of a pole located in the ground it may engage that free end and be actuated to lift upwardly and extract the pole from the ground.

The pole driver/extraction means 32 can be accurately located over the pole to be extracted preferably with the aid of a shaft (not shown) extending forwardly of the apparatus which abuts the side of one or more in-ground poles which is connected to the steering of the transportation means so as to guide the vehicle along the path of the in-ground poles. Minor manual adjustment of the steering mechanism may be required to achieve the required accuracy of path following.

A forward portion of the pole driver/extraction means 32 at approximately ground level can he used to detect the location of the pole to be extracted and as in the last embodiment, as the floating frame moves to an upright position the drive speed of the transportation means is controlled and the actuation of the pole extraction process can be initiated by the control box 64 or more preferably by the human operator on the transportation means. Human control may obviate inadvertent automatic operation if the necessary safety features are not adequate.

The poles collected are then stored on the transportation means and are ready for being driven into new locations.

The in-ground pole locating apparatus of the invention is quicker and more accurate than the manual methods used previously. However, in further contrast to the previous manual methods very much less manual labour is required to operate the in-ground pole locating apparatus and it is anticipated that a reduction in labour costs and possibly time will be achievable with the invention.

What I claim is:

1. A pole locating apparatus for locating in the ground two or more poles for supporting a racing rail assembly comprising:

a transportation means for carrying a plurality of poles, a pole driver means pivotally fixed to said transportation means and operable to drive a pole into the ground, and a first measurement means located on said transportation means operable for measuring a predetermined distance between a previously driven pole and said pole driver means, wherein as said transportation means moves along the intended path of said racing rail assembly said first measurement means measures a predetermined distance between a previously driven pole and said pole driver means, said pole driver means being actuated so as to drive a pole into the ground which is a predetermined distance from said previously driven pole.

2. The pole locating apparatus according to claim 1 further comprising:

a second measurement means located on said transportation means operable for measuring a predetermined distance between an existing rail assembly and said apparatus for maintaining a constant distance at which said poles are driven into the ground from said existing rail assembly.

3. The pole locating apparatus according to claim 1 wherein said pole drive pivotal fixing comprises a parallelogram arrangement having upper and lower ends which are arranged to allow said pole driver means to move longitudinally of said transportation means while remaining substantially vertical with respect to said transportation means.

4. The pole locating apparatus according to claim 3 wherein said first measurement means is attached to said parallelogram arrangement at its upper end and said pole driver means is attached at its lower end to said transportation means.

5. The pole locating apparatus according to claim 4 wherein said upper end of said parallelogram has a resting position which is slightly forward of vertical with respect to the transportation means and said pole locating apparatus further comprises a sensor which provides a signal representative of the closeness of the parallelogram to a right angle position with respect to the transportation means.

6. The pole locating apparatus according to claim 5 further comprising a transportation means speed of movement controller which is adapted to receive said sensor signal and slow the rate of movement of the transportation means as the parallelogram becomes closer to a position vertical with respect to the transportation means and conversely increase the speed of movement of the transportation means when the parallelogram is further away from a position vertical with respect to the transportation means.

7. The pole locating apparatus according to claim 1 wherein said pole driver means is a ram arm extendable to drive a pole temporarily located on its free end into the ground.

8. The pole locating apparatus according to claim 7 further comprising an attachment for locating on said free end of said ram for engaging the upper end of a pole located in the ground and when the ram arm is retracted extracting the pole from the ground.

9. The pole locating apparatus according to claim 1 wherein said first measurement means comprises:

a shaft attached to said pole driver means through said parallelogram extending rearwardly of said transportation means and having an engagement means at its free end arranged to engage an inground pole to provide a fixed distance between said inground pole and the pole driving means.

10. The pole locating apparatus according to claim 9 further comprising a first measurement means clearing ram which is actuated to disengage said measurement means from the previous inground pole after a pole has been driven into the ground.

* * * * *